US012790703B2

(12) United States Patent
Krause et al.

(10) Patent No.: US 12,790,703 B2
(45) Date of Patent: Nov. 10, 2026

(54) CORROSION PROTECTION IN A CO2 ELECTROLYSIS STACK

(71) Applicant: Siemens Energy Global GmbH & Co. KG, Munich (DE)

(72) Inventors: Ralf Krause, Herzogenaurach (DE); Harald Landes, Rückersdorf (DE); Erhard Magori, Feldkirchen (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 765 days.

(21) Appl. No.: 17/919,256

(22) PCT Filed: Apr. 23, 2021

(86) PCT No.: PCT/EP2021/060690
§ 371 (c)(1),
(2) Date: Oct. 15, 2022

(87) PCT Pub. No.: WO2021/233643
PCT Pub. Date: Nov. 25, 2021

(65) Prior Publication Data

US 2023/0193492 A1 Jun. 22, 2023

(30) Foreign Application Priority Data

May 20, 2020 (DE) ..... 10 2020 206 341.9

(51) Int. Cl.
*C25B 15/08* (2006.01)
*C25B 1/23* (2021.01)
(Continued)

(52) U.S. Cl.
CPC ..... *C25B 15/08* (2013.01); *C25B 1/23* (2021.01); *C25B 9/77* (2021.01); *C25B 9/75* (2021.01)

(58) Field of Classification Search
None
See application file for complete search history.

(56) References Cited

U.S. PATENT DOCUMENTS 4,364,806 A 12/1982 Rogers
2013/0001070 A1 1/2013 Stemp
(Continued)

FOREIGN PATENT DOCUMENTS

CN 108624905 A 10/2018
DE 19905565 A1 8/2000
(Continued)

OTHER PUBLICATIONS

English translation DE102018206396 (Year: 2018).*
(Continued)

*Primary Examiner* — Stefanie S Wittenberg
(74) *Attorney, Agent, or Firm* — Wolter Van Dyke Davis, PLLC

(57) ABSTRACT

A method of protecting a nonoperational $CO_2$ electrolysis stack from corrosion, includes: at least partly emptying an electrolyte from parts of a first electrolysis cell and/or of a first feed and/or of a first drain and/or of an overall feed which is connected to the first feed and the second feed and is designed to provide an inlet for the first feed and the second feed and/or of an overall drain which is connected to the first drain and the second drain and is designed to provide an outlet for the first drain and the second drain. The electrolyte which is removed by the at least partial emptying is exchanged for an inert gas or a mixture including an inert gas and liquid droplets present therein, wherein the inert gas is $CO_2$.

13 Claims, 7 Drawing Sheets

(51) Int. Cl.
*C25B 9/77* (2021.01)
*C25B 9/75* (2021.01)

(56) References Cited

U.S. PATENT DOCUMENTS

| | | | | |
|---|---|---|---|---|
| 2013/0240371 | A1 | 9/2013 | Bulan | |
| 2018/0274109 | A1 | 9/2018 | Kudo | |
| 2020/0002821 | A1 | 1/2020 | Ono | |
| 2020/0002822 | A1* | 1/2020 | Ono | C25B 9/00 |
| 2020/0087233 | A1* | 3/2020 | Ono | C25B 9/73 |
| 2021/0156036 | A1 | 5/2021 | Klink | |

FOREIGN PATENT DOCUMENTS

| | | | |
|---|---|---|---|
| DE | 102012204042 | A1 | 9/2013 |
| DE | 102018206396 | A1 | 10/2019 |
| DE | 102018208624 | A1 | 12/2019 |
| WO | 2019206568 | A1 | 10/2019 |

OTHER PUBLICATIONS

PCT International Search Report and Written Opinion of International Searching Authority mailed Aug. 11, 2021 corresponding to PCT International Application No. PCT/EP2021 /060690 filed Apr. 23, 2021.

* cited by examiner

CORROSION PROTECTION IN A CO2 ELECTROLYSIS STACK

CROSS REFERENCE TO RELATED APPLICATIONS

This application is the US National Stage of International Application No. PCT/EP2021/060690 filed 23 Apr. 2021, and claims the benefit thereof. The International Application claims the benefit of German Application No. DE 10 2020 206 341.9 filed 20 May 2020. All of the applications are incorporated by reference herein in their entirety.

FIELD OF INVENTION

The invention relates to a method of protecting a $CO_2$ electrolysis stack from corrosion, to a method of transporting a $CO_2$ electrolysis stack, and to a $CO_2$ electrolysis stack.

BACKGROUND OF INVENTION

Electrolysis uses power to produce materials of value. For maintenance of an efficient mode of operation, an electrolyte is typically required here, which can conduct the current through electrolysis cells. However, this electrolyte frequently comprises substances that can be corrosive to the material of electrolysis cells, especially electrodes, under particular conditions. Especially in the case of electrolysis stacks comprising multiple electrolysis cells, different conditions arise here in the individual cells that are not in operation.

Standby operation of an electrolysis stack, for example of a $CO_2$ electrolysis stack, has to date involved operating it with a low load current in order to prevent the oxidation of the electrodes, for example of Ag cathodes. The potential division along the stack at these low load currents is less well defined than in load operation owing to the scatter in the characteristics of the individual cells. There is thus the risk that the necessary protection potential will not be attained in individual cells in a series connection, while it is exceeded in others, which is not a problem.

Moreover, there are always short-circuit currents flowing via the manifold or the distribution structures along the stack, and these can extend the region of oxidation of electrolysis cell components, for example of silver oxidation, to the potential layers of the electrodes especially in the region of the manifold connections to the cells, the long-term effect of which can be destruction of the electrode structure. "Manifold" generally means distributor structure. Each cell has its own internal distributor structures. The joint supply of the cells of a stack requires further overarching distributor structures. Consequently, these two levels (cell level and stack level) can be assigned to the respective manifold.

In order to prevent this, an electrolysis stack, even when out of operation, has to date been supplied with a sufficiently high standby current, such that oxidation of constituents of the stack, especially of electrodes, for example silver oxidation in the case of silver-containing electrodes, can be prevented throughout. However, this is associated with considerable energy expenditure.

In order to avoid this elevated energy expenditure, it is possible to control the potential of individual cell levels. For this purpose, for each bipolar plate of the stack, an electrical connection should then be provided, which is associated with high apparatus complexity. It is additionally questionable whether the energy consumption of this solution is any lower than the use of a sufficiently large minimum load current.

Furthermore, the incorporation of long electrolyte conduits of low cross section between the cells is also possible, in order to minimize the stray current. Disadvantages here, however, are the extra complexity and compromises in the performance of the stack, and so this solution is not very suitable, especially in stacks with an internal manifold, for example plate cells and internal supply cells.

A further concept for avoiding the problem is the concept of monopolar cell stacks. In this case, all electrolysis cells are electrically in parallel connection, and so stray current problems do not arise. However, this is disadvantageous because of the need to route all the individual cell connections to the outside, and owing to the very high operating current at low operating voltage.

A further means of cell operation with minimized stray currents is the incorporation of drops for interruption of the liquid flow, where the electrolyte flow breaks up into individual bundles that are no longer conductive, which are then interrupted by gas, for example. However, this is again associated with extra complexity, and is not very suitable in cells with an internal manifold, for example plate cells and internal supply cells, and has also not been considered for nonoperation to date. This also results in an elevated demand in the conveying of electrolyte.

There is therefore a need for methods of effective protection of electrolysis stacks from corrosion, especially in nonoperation and also in the case of transport, without or with a minimum of extra complexity.

SUMMARY OF INVENTION

The inventors have found that simple emptying of electrolyte can create a suitable interruption of the current in the electrolyte within the electrolyte distribution or manifold, and in this context in particular have found preferred suitable points for interruption, and also very simple solutions for corrosion protection in electrolysis stacks. It has also been found that better protection can be achieved by introducing inert materials. The measures found are suitable for prolonged shutdown times, for example even in the transport of a stack that has already been in operation, for example a large and/or new one, especially when insufficiently high-output power supply is available to maintain a protective current—as will be set out in detail later on. In particular, the present methods and the electrolysis stack can even achieve a shutdown without electrical power demand, which can quite possibly be considerable, depending on the stray current and electrolysis current, and which must typically still be maintained for safe switch-off. Moreover, the invention also results in an advantage in that no operating media have to be available in the event of a switch-off and no products have to be collected safely, examples of which in the case of $CO_2$ as reactant, for example, are products such as $O_2$, $H_2$, CO and others on the cathode side. It is thus also possible to reduce and even rule out any explosion risk. In the case of a nonoperational plant that has been shut down, it is additionally possible to dispense with any heating device to prevent freezing of the electrolyte at very cold sites.

A first aspect of the present invention relates to a method of protecting a nonoperational $CO_2$ electrolysis stack from corrosion, wherein the $CO_2$ electrolysis stack comprises at least a first electrolysis cell and a second electrolysis cell, at least a first feed and at least a first drain for the first electrolysis cell and at least a second feed and at least a second drain for the second electrolysis cell, wherein at least the first electrolysis cell and the second electrolysis cell and at least the at least one first feed and the at least one second feed are partly filled with at least one electrolyte, comprising: at least partly emptying the electrolyte from parts of at least the first electrolysis cell and/or of the at least one first feed and/or of the at least one first drain and/or of an overall feed which is connected to the at least one first feed and the at least one second feed and is designed to provide an inlet for the at least one first feed and the at least one second feed and/or of an overall drain which is connected to the at least one first drain and the at least one second drain and is designed to provide an outlet for the at least one first drain and the at least one second drain, wherein the electrolyte which is removed by the at least partial emptying is exchanged for an inert gas or a mixture comprising an inert gas and liquid droplets, e.g. water droplets, present therein, wherein the inert gas is $CO_2$.

Further disclosed is a method of transporting a $CO_2$ electrolysis stack, wherein the $CO_2$ electrolysis stack comprises at least a first electrolysis cell and a second electrolysis cell, at least a first feed and at least a first drain for the first electrolysis cell and at least a second feed and at least a second drain for the second electrolysis cell, comprising at least partly filling the $CO_2$ electrolysis stack with an inert gas or a mixture comprising an inert gas and liquid droplets present therein, wherein the inert gas is $CO_2$.

A method of protecting a nonoperational electrolysis stack, especially a $CO_2$ electrolysis stack, from corrosion is described, wherein the electrolysis stack comprises at least a first electrolysis cell and a second electrolysis cell, at least a first feed and at least a first drain for the first electrolysis cell and at least a second feed and at least a second drain for the second electrolysis cell, wherein at least the first electrolysis cell and the second electrolysis cell and at least the at least one first feed and the at least one second feed are partly filled with at least one electrolyte, comprising: introducing at least one first isolator at least into the at least one first feed to the first electrolysis cell in such a way that at least the entire cross-sectional area of the at least one first feed is occupied by the first isolator; and/or introducing at least one second isolator at least into the at least one first drain in such a way that at least the entire cross-sectional area of the at least one second feed is occupied by the second isolator; and/or introducing at least one third isolator at least into an overall feed which is connected to the at least one first feed and the at least one second feed and is designed to provide an inlet for the at least one first feed and the at least one second feed, in such a way that at least the entire cross-sectional area of the overall feed in flow direction between the at least one first feed and the at least one second feed is occupied by the third isolator; and/or introducing at least one fourth isolator at least into an overall drain which is connected to the at least one first drain and the at least one second drain and is designed to provide an outlet for the at least one first drain and the at least one second drain, in such a way that at least the entire cross-sectional area of the overall drain in flow direction between the at least one first drain and the at least one second drain is occupied by the fourth isolator.

Additionally disclosed is a $CO_2$ electrolysis stack comprising:

at least a first electrolysis cell and a second electrolysis cell, at least a first feed and at least a first drain for the first electrolysis cell, at least a second feed and at least a second drain for the second electrolysis cell, an overall feed which is connected to the at least one first feed and the at least one second feed and is designed to provide an inlet for the at least one first feed and the at least one second feed, and an overall drain which is connected to the at least one first drain and the at least one second drain and is designed to provide an outlet for the at least one first drain and the at least one second drain, further comprising:

at least one first side drain which is connected to the at least one first feed and is designed such that it can at least partly empty any electrolyte present in the at least one first feed therefrom, at least one second side drain which is connected to the at least one first drain and is designed such that it can at least partly empty any electrolyte present in the at least one first drain therefrom, at least one third side drain which is connected to the at least one second feed and is designed such that it can at least partly empty any electrolyte present in the at least one second feed therefrom, and/or at least one fourth side drain which is connected to the at least one second drain and is designed such that it can at least partly empty any electrolyte present in the at least one second drain therefrom, further comprising a first side feed which is connected to the at least one first feed and is designed such that it can supply an inert gas or a mixture comprising an inert gas and liquid droplets present therein to the at least one first feed, a second side feed which is connected to the at least one first drain and is designed such that it can supply an inert gas or a mixture comprising an inert gas and liquid droplets present therein to the at least one first drain, a third side feed which is connected to the at least one second feed and is designed such that it can supply an inert gas or a mixture comprising an inert gas and liquid droplets present therein to the at least one second feed, and/or a fourth side feed which is connected to the at least one second drain and is designed such that it can supply an inert gas for a mixture comprising an inert gas and liquid droplets present there into the at least one second drain, wherein the inert gas is $CO_2$.

Further aspects of the present invention can be inferred from the dependent claims and the more detailed description.

The appended drawings are intended to illustrate embodiments of the present invention and to impart further understanding thereof. In association with the description, they serve to elucidate concepts and principles of the invention. Other embodiments and many of the advantages mentioned will be apparent with regard to the drawings. The elements of the drawings are not necessarily shown true to scale relative to one another. Elements, features and components that are the same, have the same function and the same effect are each given the same reference numerals in the figures of the drawings, unless stated otherwise.

DETAILED DESCRIPTION OF INVENTION

Figure 1:
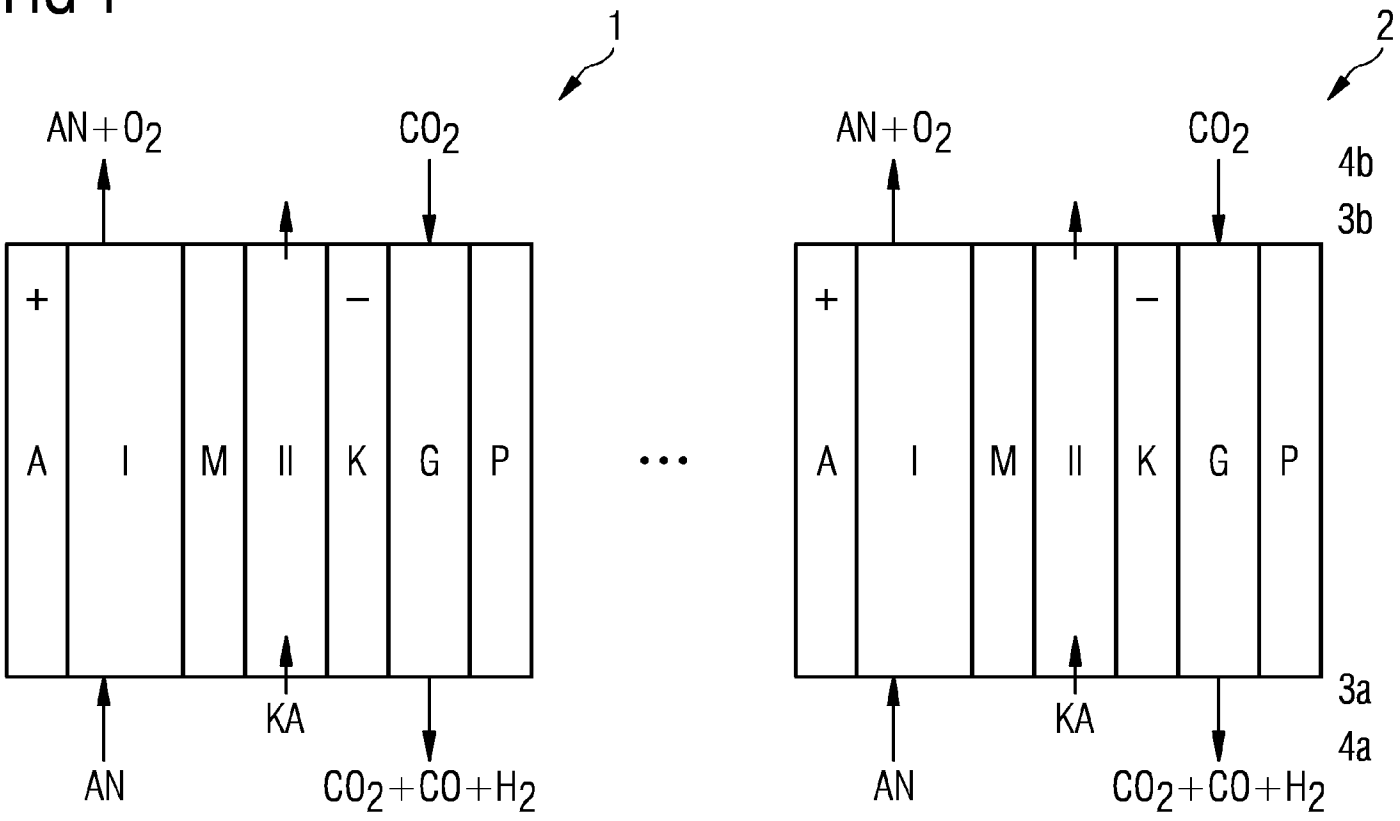
FIGS. 1 to 3 show schematics of load currents and stray currents in an electrolysis stack in operation and nonoperation.

Unless defined differently, technical and scientific expressions used herein have the same meaning as commonly understood by a person skilled in the art in the technical field of the invention.

What is meant by "nonoperation" in the context of the invention that follows is a state in which the electrolysis cell is not conducting any electrolytic conversion for production of a product of value to the customary degree. In particular, nonoperation encompasses periods of running down an electrolysis cell, maintenance periods, periods of economic unviability, for example when power is too costly, periods of inadequate availability of power and/or raw materials for the electrolysis, transport periods, retrofitting periods, etc. For example, nonoperation may also encompass prolonged shutdown times during which an electrolyte is at least partly discharged and hence further electrolytic current flow, as described hereinafter, preferably throughout or at least between electrolysis cells, can be hindered or even prevented.

Gas diffusion electrodes (GDE) are electrodes in which there are liquid, solid and gaseous phases, and where, in particular, a conductive catalyst catalyzes an electrochemical reaction between the liquid and gaseous phases. In the electrolysis cells of the present electrolysis stack, it is especially possible for electrodes, for example the cathodes, especially in the case of $CO_2$ electrolysis, to take the form of gas diffusion electrodes. It is not ruled out that anodes take the form of gas diffusion electrodes. Especially for gas diffusion electrodes, and especially for those as cathodes in a $CO_2$ electrolysis, effective corrosion protection is of particular significance and is accordingly also particularly effective in order to protect the electrode structure.

In the context of the invention, partial emptying corresponds to emptying of at least 50% by volume, preferably at least 80% by volume, further preferably at least 90% by volume, even further preferably at least 92% by volume, of the defined component of the electrolysis stack or of the entire electrolysis stack. Essentially complete emptying corresponds to emptying of at least 95% by volume, even further preferably at least 99% by volume, of the defined component of the electrolysis stack or of the entire electrolysis stack. Complete emptying corresponds to emptying of 100% by volume, apart from emptying in inaccessible parts, or of parts that cannot be emptied owing to other barriers, of the component or of the electrolysis stack. The emptying relates here to a removal of the electrolyte, with what is used to replace the electrolyte being insignificant here at first, provided that no other electrolyte or other electrically conductive substance is introduced.

Corrosion of parts of the electrolysis stack may arise, for example, particularly on account of load currents and/or stray currents, even in nonoperation, which can occur within the electrolysis stack. The way in which such load currents and/or stray currents arise will now be further clarified hereinafter both for the case of operation and for that of nonoperation of an electrolysis stack.

Figure 2:
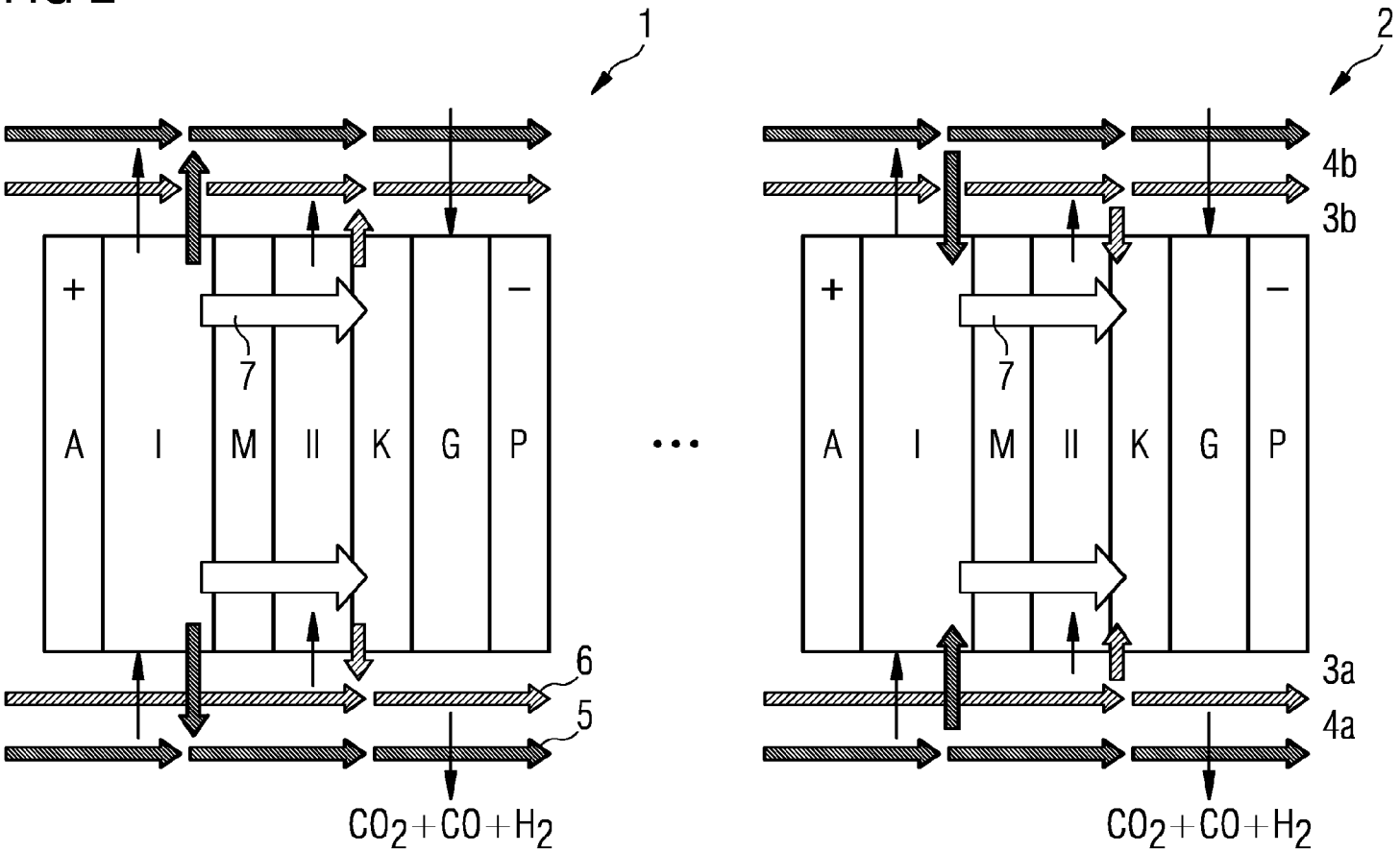
Figure 3:
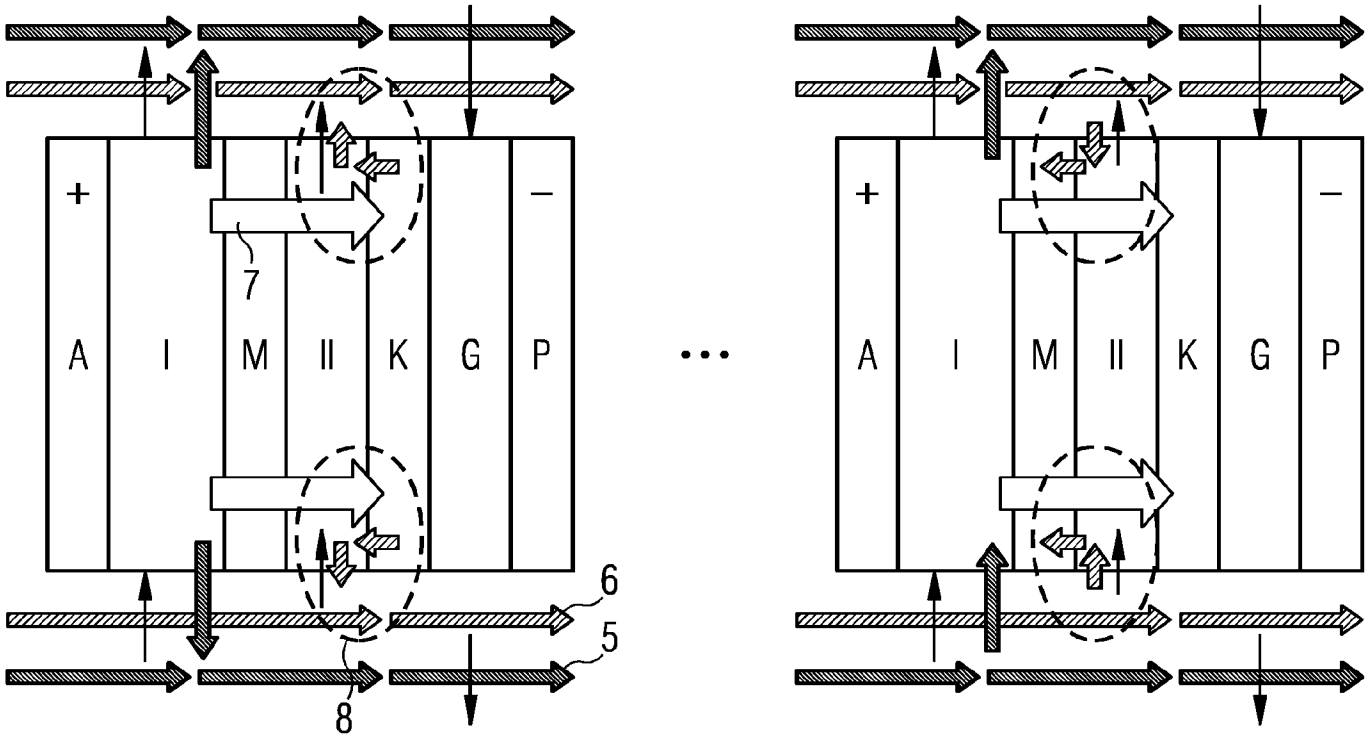

These are shown by way of example in FIGS. 1 to 3, in operation and nonoperation, for an electrolysis stack having two terminal electrolysis cells 1 and 2, i.e. a first electrolysis cell 1 and a second electrolysis cell 2, where further electrolysis cells may typically be present, and typically are present, in the stack between the two terminal illustrative electrolysis cells 1 and 2, as shown in the present context by the dots between the two electrolysis cells 1 and 2 in FIGS. 1 to 3. Each of the electrolysis cells, for example electrolysis cells 1 and 2, here by way of example has an anode A, a cathode K and a membrane M, none of which are restricted, although other arrangements than those shown here are possible for electrolysis cells in electrolysis stacks in methods and electrolysis stacks of the invention, possibly even without a membrane, and the details shown here with regard to the load currents and stray currents are analogous.

In the electrolysis stacks shown in FIGS. 1 to 3, an anolyte AN is guided through an anode space I and a catholyte KA through a cathode space II, with formation of oxygen as well here, for example, at the anode A, for example in a water electrolysis. The anolyte AN and catholyte KA are not particularly restricted, and may, for example, independently be aqueous electrolytes containing suitable conductive salts, but may also have a different configuration. In the electrolysis cells 1 and 2, there is additionally also a gas space G which adjoins the cathode K and into which $CO_2$ by way of example is introduced, and the illustrative product discharged is a mixture of unconverted $CO_2$, CO as the actual product and $H_2$ as a by-product. However, it is also possible here that other products are formed, for example depending on a catalyst in the cathode K. There are typically boundary components, for example bipolar plates P here, between electrolysis cells in the electrolysis stack.

In FIG. 1, it becomes clear here that the gas flow at the cathode K in flow-by operation is from the top downward, while the electrolyte flow of catholyte KA and also anolyte AN is from the bottom upward. In FIG. 1, catholyte KA and anolyte AN are fed in via the stack at the bottom from left to right respectively via a catholyte intake manifold 3*a* and an anolyte intake manifold 4*a*, and catholyte KA and anolyte AN are removed respectively via a catholyte outlet manifold 3*b* and an anolyte outlet manifold 4*b*, which continue to the right, but this is not shown here in detail for the sake of simplicity. The manifolds are shown more clearly in FIG. 2, in which the catholyte and anolyte stray currents 5 and 6 along the manifolds are shown by the arrows outside the electrolysis cells 1 and 2.

The stray currents and load currents within the electrolysis stacks are apparent here in principle from FIG. 2. Both the catholyte stray currents 6 and the anolyte stray currents 5 are shown here. Additionally shown are load currents 7 within the electrolysis cells 1 and 2. In FIG. 3, in addition, a stray current 8 that occurs solely in the proximity of the catholyte connection is additionally apparent in the region bounded by a dotted line. This is the point where it exits from the cathode, while the load current enters there—as it does along the entire cell surface. The two currents are additive. In the case of small load current densities, therefore, the cumulative current density can change sign at the positive end of the stack, which causes the cathode to corrode. At the negative end of the stack, the anode tends to reverse current density.

Figure 4:
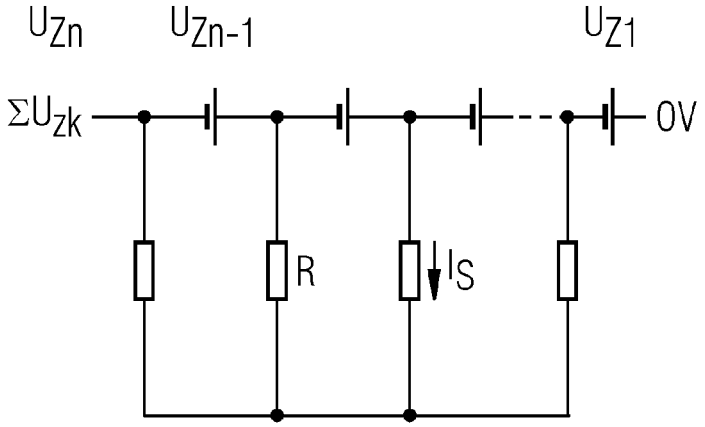
FIG. 4 shows an equivalent circuit diagram for an electrolysis stack with a manifold.

By way of further illustration of the corresponding electrical states, FIG. 4 shows an equivalent circuit diagram of an electrolysis stack with electrolyte manifold having a respective resistance R and current $I_S$ in the manifold and the different voltages of the cells $U_{Z1}$ to $U_{Zn}$ through k=1 to n cells, in which case a cumulative voltage arises over all $U_{Zk}$ voltages. This can correspondingly be used to infer the stray currents and load currents.

In order to avoid any corrosion by stray currents and/or load currents, the present methods are employed, which can especially find use in the electrolysis stacks of the invention.

In the context of the present invention, electrolysis stacks are especially stacks with an internal manifold, for example plate cells or internal supply cells. An internal manifold is present here at the stack level. This means that the manifold is integrated within the stack, and is also called (stack) internal supply. Especially the design of a plate cell harmonizes well with the concept of an internal supply, and so preferred electrolysis cells are plate cells.

In a first aspect, the present invention relates to a method of protecting a nonoperational $CO_2$ electrolysis stack from corrosion, wherein the $CO_2$ electrolysis stack comprises at least a first electrolysis cell and a second electrolysis cell, at least a first feed and at least a first drain for the first electrolysis cell and at least a second feed and at least a second drain for the second electrolysis cell, wherein at least the first electrolysis cell and the second electrolysis cell and at least the at least one first feed and the at least one second feed are partly filled with at least one electrolyte, comprising: at least partly emptying the electrolyte from parts of at least the first electrolysis cell and/or of the at least one first feed and/or of the at least one first drain and/or of an overall feed which is connected to the at least one first feed and the at least one second feed and is designed to provide an inlet for the at least one first feed and the at least one second feed and/or of an overall drain which is connected to the at least one first drain and the at least one second drain and is designed to provide an outlet for the at least one first drain and the at least one second drain, wherein the electrolyte which is removed by the at least partial emptying is exchanged for an inert gas or a mixture comprising an inert gas and liquid droplets, e.g. water droplets, present therein, wherein the inert gas is $CO_2$.

The method in the first aspect is a method of protecting a nonoperational $CO_2$ electrolysis stack from corrosion, wherein corrosion of at least parts of the nonoperational electrolysis stack here is reduced or can even be completely prevented, for example of electrode materials in a $CO_2$ electrolysis of catalysts in the cathode and/or anode, e.g. Ag in the case of reduction of $CO_2$ to CO, as described by way of background above. $CO_2$ electrolysis stacks in particular profit from the measures in the methods of the invention. In these, parts of the stack in particular, for example electrode materials, are subject to a risk of corrosion, which can arise, for example, also on account of electrolytes used specifically for this purpose and/or else by-products of the electrolysis.

In the method of the invention for corrosion protection in non-operation, but also in the other methods of the invention and in the electrolysis stack of the invention, the $CO_2$ electrolysis stack comprises at least a first electrolysis cell and a second electrolysis cell. However, it is also possible for more than two electrolysis cells to be present in the electrolysis stack, preferably at least 3, for example at least 4, 5, 6, 7, 8, 9, 10, 11, 12, 13, 14, 15, 16, 17, 18, 19, 20, at least 30, at least 40, at least 50, at least 60, at least 70, at least 80, at least 90, or at least 100, or else at least any number in between or higher number.

In the method of the invention for protection of a nonoperational $CO_2$ electrolysis stack from corrosion, the at least one first and second electrolysis cells, the at least one first feed and at least one first drain for the first electrolysis cell and the at least one second feed and at least one second drain for the second electrolysis cell are not particularly restricted, provided that they are at least partly filled with at least one electrolyte, for example to an extent of at least 50% by volume, at least 80% by volume, at least 90% by volume or at least 92% by volume, and preferably essentially filled, i.e. to an extent of at least 95% by volume, further preferably to an extent of at least 99% by volume and especially completely.

It is also not ruled out that a respective electrolysis cell has more than one electrolyte, for example a catholyte on the cathode side and an anolyte on the anode side, which may be separated, for example, by a suitable separator, e.g. a diaphragm or membrane, in the respective electrolysis cell. In this case, for example, the catholyte is fed in via at least a first and at least a second catholyte feed and an overall catholyte feed, and a catholyte is removed via at least a first and at least a second catholyte drain and an overall catholyte drain, and the anolyte is fed in via at least a first and at least a second anolyte feed and an overall anolyte drain, and an anolyte is removed via at least a first and at least a second anolyte drain and an overall anolyte drain, which may correspondingly each be emptied at least in part, preferably essentially completely or especially completely, in the corresponding methods.

The at least one electrolyte or else multiple electrolytes, and also any separators present and also further constituents of the respective electrolysis cells, are not particularly restricted. In particular embodiments, the cathodes of the respective electrolysis cells are gas diffusion electrodes, and are correspondingly suitable, for example, for $CO_2$ reduction.

Likewise not particularly restricted, and possible in any suitable manner, is the at least partial emptying of the electrolyte from parts of at least the first electrolysis cell and/or the at least one first feed and/or the at least one first drain and/or an overall feed which is connected to the at least one first feed and the at least one second feed and is designed to provide an inlet for the at least one first feed and the at least one second feed, and/or an overall drain which is connected to the at least one first drain and the at least one second drain and is designed to provide an outlet for the at least one first drain and the at least one second drain. According to the invention, emptying is effected by displacement with an inert gas or any mixture comprising inert gas and liquid droplets present therein, wherein the inert gas is $CO_2$.

It is not ruled out in accordance with the invention that an electrolysis cell has more than one feed and/or one drain. If an electrolysis cell has multiple feeds and/or drains, it is preferable that all feeds and/or drains to/from an electrolysis cell are at least partly emptied. In particular embodiments, however, each electrolysis cell has a feed and/or a drain for an electrolyte.

Nor is it ruled out that each electrolysis cell has further feeds which, for example, supply a reactant, for example a reactant gas cathode feed for, for example, a gas comprising $CO_2$ on the cathode side, or another reactant having a general cathode feed, and/or a gas and/or a liquid on the anode side, for example an anode feed, and corresponding cathode product and/or anode product drains. In particular executions, at least one reactant gas cathode feed per electrolysis cell is included, which is designed to supply a reactant gas comprising $CO_2$. In particular embodiments, one cathode product drain per electrolysis cell is additionally provided, which is designed to remove a product of the electrolysis on the cathode side. Correspondingly, in particular embodiments, anode reactant feeds and/or anode product drains are also provided for each electrolysis cell, each of which is respectively designed to supply a reactant to the anode and to remove a product from the anode. The respective reactant feeds and/or product drains are not particularly restricted either. It is possible to supply a reactant to the reactant feeds for all electrolysis cells via a common overall reactant feed, optionally also separately for reactants for the cathodes and anodes of the respective electrolysis cells, and to remove products from the electrolysis cells, after removal via the respective product drains, via a common overall product drain, optionally likewise for products from the cathodes and anodes of the respective electrolysis cells. In particular executions, it is also possible to at least partly empty the reactant feeds and/or product drains and/or the respective overall reactant feed and/or the respective overall product drain in nonoperation, but these are preferably emptied essentially completely in nonoperation, i.e. to an extent of more than 90% by volume, more than 95% by volume or more than 99% by volume, also in order not to waste any reactant and/or product. These conduits, i.e. the reactant conduits and/or product conduits and/or the respective overall reactant feed and/or the respective overall product drain, in nonoperation are preferably filled with an inert medium, for example gas. In the present context, however, the stray currents and load currents arise mainly on account of the electrolytes, and so the partial emptying thereof is of higher significance.

Emptied electrolyte, in particular embodiments, may suitably be stored intermediately for a later reuse, for example in an intermediate storage means, where the intermediate storage means may also be an electrolyte reservoir for the electrolysis stack. Correspondingly, a $CO_2$ electrolysis stack of the invention, as described hereinafter, may also comprise at least one electrolyte reservoir, and possibly also at least two electrolyte reservoirs, one each for catholyte and anolyte.

In particular embodiments, at least the overall feed and/or the overall drain is at least partly emptied, preferably to an extent of at least 50% by volume, at least 80% by volume, at least 90% by volume or at least 92% by volume, and further preferably essentially emptied, i.e. to an extent of at least 95% by volume, even further preferably to an extent of at least 99% by volume and especially completely. This can suppress any flow of current via these conduits, such that stray currents and load currents are minimized. In order to enable very substantially complete or even complete emptying of the overall feed and/or overall drain, it is also possible in particular embodiments that any connection between the respective feeds, i.e., for example, the at least one first and second feeds, and the overall feed, and/or any connection between the respective drains, i.e., for example, the at least one first and second drains, and the overall drain, is closed in such a way that no electrolyte can flow from the respective feeds and/or drains into the overall feed and/or the overall drain, for example by means of a suitable barrier device which is not particularly restricted.

Suitable barrier devices in methods and apparatuses of the invention are, for example, slide gates, locks, valves, etc., although these are not particularly restricted. If the electrolyte is removed at least partly, preferably essentially completely and especially completely, from parts or the entirety of the electrolysis stack, the material of the barrier device here is not particularly restricted either. In particular embodiments, the barrier device is electrically nonconductive, especially when electrolyte still remains in the electrolysis stack.

In particular embodiments, the overall feed and the overall drain are at least partly and preferably essentially completely or completely emptied. When the overall feed and/or the overall drain are emptied, this has the advantage that the further constituents of the electrolysis stack need not be emptied, and so an intermediate storage means for emptied electrolytes may be smaller.

In particular embodiments, at least the at least one first feed is partly emptied. In particular embodiments, the first feed is emptied in full, i.e. completely. In particular embodiments, the first feed and the first drain and optionally the first electrolysis cell are at least partly and preferably essentially completely or completely emptied. In this way, a stray current and load current between the first and second electrolysis cells can be reduced or even prevented, since electrical contacting of the first electrolysis cell by the electrolytes is reduced or even prevented. If there are more than two electrolysis cells, it is sufficient to at least partly, essentially completely or completely empty all but one of the feeds and/or drains and optionally electrolysis cells, since only these are then in electrical contact. For process-related reasons, however, it is simpler here as well to at least partly, essentially completely or even completely empty all the feeds and/or drains and optionally electrolysis cells. In the emptying of feeds and/or drains, however, it is also sufficient when the corresponding conduits are at least partly emptied in such a way that there is a region in the respective feed and/or drain in which there is essentially no electrolyte, i.e. there is a kind of "interruption" in the electrolyte. This can be effected, for example, by means of side feeds and optionally side drains on the feeds and/or conduits, via which a medium other than the electrolyte, as described above by way of example, can be introduced into at least portions of the respective feed and/or drain, in which case it is optionally also possible, by means of one or more barrier devices, as described above, for the electrolyte to remain in the remainder of the respective feed and/or drain, or for the electrolyte to be merely emptied in a simple manner, for example via a first outlet device or a first side drain—as also described hereinafter, in which case it is possible here too to use one or more barrier devices in order otherwise to retain the electrolyte.

In particular embodiments, at least the at least one first feed and the at least one second feed are at least partly emptied in such a way that there is a region in each of the at least one first feed and the at least one second feed in which there is essentially no electrolyte. In this way, an electrical interruption can be effected on the feed side. If there are multiple feeds for multiple electrolysis cells in an electrolysis stack, in particular, all the feeds are emptied at least partly, preferably essentially completely or completely. This is especially advantageous in the case of electrolysis stacks in which gases can form in the electrolysis in the electrolysis cells, and in which gases may then correspondingly also be present in the drains, for example in a $CO_2$ electrolysis.

In particular embodiments, moreover, at least the at least one first drain and the at least one second drain- or preferably all the drains in the case of multiple electrolysis cells—are at least partly emptied in such a way that there is a region in each of the at least one first drain and the at least one second drain in which there is essentially no electrolyte, in order thus also to bring about an electrical interruption on the drain side. In particular, in the embodiments described here, it is also possible to further reduce the amount of emptied electrolyte compared to emptying of the entire feed and preferably also the entire drain, since even a small region without electrical contact can be sufficient. At least partial emptying of the drains is also important especially when no gases that can be removed through the drains are formed in the electrolysis.

It should especially be noted that the electrolyte need not be removed from the electrolysis cells since only the flow of current between electrolysis cells is to be reduced or prevented, such that complicated refilling may possibly be avoided.

The electrolyte which is removed by the at least partial emptying is exchanged for an inert gas or a mixture comprising an inert gas and liquid droplets present therein, for example of zero or low electrical conductivity, e.g. water droplets, where the inert gas is $CO_2$. In this way, the electrolyte can simply be displaced in the emptying and flow of current can be prevented. Moreover, ingress of oxidizing atmospheric constituents such as oxygen can be reduced or even prevented. In the present context, the inert gas used in a $CO_2$ electrolysis is $CO_2$, which may be slightly moistened, for example, and so it is essentially also possible here to make use of the reactant gas for the electrolysis on the cathode side, which can be provided, for example, from a reactant reservoir. It is advantageous here that the reactant gas can simultaneously be used as inert gas.

It is also not ruled out here that individual or all reactant feeds and/or product drains and/or spaces for converting the reactants on the cathode side and/or anode side, for example a cathode gas space which may be connected to a reactant gas cathode feed and a product gas cathode drain and/or a corresponding anode (gas) space with corresponding reactant feeds and/or product drains, is likewise exchanged for the inert gas or a mixture comprising an inert gas and liquid droplets present therein, for example of zero or low electrical conductivity, e.g. water droplets, i.e. is discharged.

For example, it is also possible to fill electrolyte spaces and optionally gas spaces of an electrolysis cell or of multiple or all electrolysis cells with the inert gas or a mixture comprising an inert gas and liquid droplets present therein, for example of zero or low electrical conductivity, e.g. water droplets, after emptying, in order thus to achieve additional protection from the surrounding atmosphere and, for example, oxygen in particular.

According to the invention, the inert gas or the mixture comprising the inert gas and liquid droplets present therein, for example of zero or low electrical conductivity, especially water, is introduced, especially with continuous flow, in order that it can be ensured that no ambient gas penetrates via diffusion or leakage. The inert gas is preferably moistened. By introduction of the inert gas or of the mixture comprising the inert gas and liquid droplets present therein, it is especially possible to blow the electrolyte even out of areas of difficult accessibility.

In particular embodiments, the entire electrolysis stack is filled with the inert gas or the mixture comprising the inert gas and liquid droplets present therein. In this way, it is particularly advantageously also possible to prevent penetration of oxidative constituents such as oxygen.

In particular embodiments, the $CO_2$ electrolysis stack comprises a multitude of electrolysis cells having a number of three or more, for example four or more, five or more, six or more, seven or more, eight or more or nine or more, preferably ten or more, further preferably 20 or more, especially preferably 50 or more, electrolysis cells—as described above, wherein the electrolyte is at least partly emptied at least from portions of the electrolysis cells and/or the feeds to the electrolysis cells, in each case at the edge of the $CO_2$ electrolysis stack. As apparent from FIG. 4, especially at the ends of the cell stack, the voltage is additive-which results in an elevated load current, which can lead to a reversal of current as in a battery, such that corrosion is preferentially to be reduced or prevented there. The higher the number of electrolysis cells here, the greater the extent to which a perceptible effect with regard to reduction in corrosion is indeed achieved.

As described above, the load currents and stray currents can result in occurrence of inequality in the voltages applied to the cells. Typically, even in nonoperation, it is possible still to apply current to an electrolysis stack that generally counteracts these stray currents and load currents and hence protects the electrodes. As a result of the inequality of the voltage applied, however, it may be the case, especially at the ends of the electrolysis stack, that the current applied is insufficient, resulting in corrosion there. In this respect, especially at the ends of the electrolysis stack, special protection is required, which is especially achieved by the method of the invention in that this is especially applied to electrolysis cells, feeds and/or drains at and possibly close to the ends of the electrolysis stack (according to the number of cells in the stack).

In particular embodiments, current is still being applied to electrodes of the electrolysis cells. This additionally serves for corrosion protection, as just described, especially when not all the electrolyte is emptied.

Likewise disclosed, in a second aspect, is a method of transporting a $CO_2$ electrolysis stack, wherein the $CO_2$ electrolysis stack comprises at least a first electrolysis cell and a second electrolysis cell, at least a first feed and at least a first drain for the first electrolysis cell and at least a second feed and at least a second drain for the second electrolysis cell, comprising at least partly filling the $CO_2$ electrolysis stack with an inert gas or a mixture comprising an inert gas and liquid droplets present therein, wherein the inert gas is $CO_2$.

The wherein the inert gas is $CO_2$ electrolysis stack and its constituents, the inert gas, and the mixture comprising an inert gas and liquid droplets present therein correspond to the constituents mentioned in the method of protecting a nonoperational electrolysis stack from corrosion in the first aspect, to the inert gas, and to the mixture comprising an inert gas and liquid droplets present therein that have already been described above. Accordingly, reference is made here to the above details, which are also employed in the method of transporting a $CO_2$ electrolysis stack. As in the method of protecting a nonoperational $CO_2$ electrolysis stack from corrosion as well, the inert gas or the mixture comprising the inert gas and liquid droplets present therein achieves protection from corrosion since both the penetration of oxidizing substances and that of excess moisture, for example, and hence any occurrence of load currents and stray currents can be reduced or prevented. The filling here is not particularly restricted. In particular, it is effected completely, preferably with a gas comprising $CO_2$ and optionally liquid droplets, especially water, if the stack is to be used later in a $CO_2$ electrolysis application. The $CO_2$ electrolysis stack may likewise comprise further constituents that are mentioned in connection with the method in the first aspect and the $CO_2$ electrolysis stack of the invention, and so reference is made here too to the corresponding details, to which reference is made here and which can also be employed correspondingly in the method of the second aspect.

In particular embodiments, at least the at least one first feed, the at least one second feed, the at least one first drain and the at least one second drain are at least partly filled, in such a way that there is a region in which there is essentially the inert gas or the mixture comprising an inert gas and liquid droplets present therein in each of the at least one first feed, the at least one second feed, the at least one first drain and the at least one second drain. In this way, it is possible to effectively reduce or prevent penetration of oxidative substances and excess moisture, etc., even with reduced amounts of inert gas with or without liquid droplets.

It is also not ruled out that a particular electrolysis cell in later operation may have more than one electrolyte, for example a catholyte on the cathode side and an anolyte on the anode side, which may be separated, for example, by a suitable separator, e.g. a diaphragm or membrane, in the respective electrolysis cell. In this case, for example, the catholyte is fed in via at least a first and at least a second catholyte feed and an overall catholyte feed, and a catholyte is removed via at least a first and at least a second catholyte drain and an overall catholyte drain, and the anolyte is fed in via at least a first and at least a second anolyte feed and an overall anolyte drain, and an anolyte is removed via at least a first and at least a second anolyte drain and an overall anolyte drain, which may correspondingly each be filled with the inert gas or the mixture comprising the inert gas and liquid droplets present therein.

A third method of protecting a nonoperational electrolysis stack is described, especially a $CO_2$ electrolysis stack, wherein the electrolysis stack comprises at least a first electrolysis cell and a second electrolysis cell, at least a first feed and at least a first drain for the first electrolysis cell and at least a second feed and at least a second drain for the second electrolysis cell, wherein at least the first electrolysis cell and the second electrolysis cell and at least the at least one first feed and the at least one second feed are partly filled with at least one electrolyte, comprising: introducing at least one first isolator at least into the at least one first feed to the first electrolysis cell in such a way that at least the entire cross-sectional area of the at least one first feed is occupied by the first isolator; and/or introducing at least one second isolator at least into the at least one first drain in such a way that at least the entire cross-sectional area of the at least one second feed is occupied by the second isolator; and/or introducing at least one third isolator at least into an overall feed which is connected to the at least one first feed and the at least one second feed and is designed to provide an inlet for the at least one first feed and the at least one second feed, in such a way that at least the entire cross-sectional area of the overall feed in flow direction between the at least one first feed and the at least one second feed is occupied by the third isolator; and/or introducing at least one fourth isolator at least into an overall drain which is connected to the at least one first drain and the at least one second drain and is designed to provide an outlet for the at least one first drain and the at least one second drain, in such a way that at least the entire cross-sectional area of the overall drain in flow direction between the at least one first drain and the at least one second drain is occupied by the fourth isolator.

In this third method, the constituents mentioned correspond to those of the method of the first aspect, and it is also possible in this method to employ the further constituents and embodiments of the method of the first aspect, and also the constituents and embodiments of the $CO_2$ electrolysis stack of the invention that follow, and so reference is hereby made to the corresponding details, configurations and embodiments.

In this third method, the interruption of the contact that results from remaining electrolytes is achieved by the first, second, third and/or fourth isolator which is electrically insulating but is otherwise subject to no further restriction, provided that the cross-sectional area of the respective feed and/or drain and/or of the overall feed and/or overall drain is occupied thereby. In this context, the respective isolator ensures an interruption in the stray currents and load currents, such that corrosion can likewise be reduced and even prevented here. The principles of the interruption of the stray currents and load currents are the same here as in the method of the first aspect, and so reference is made thereto. However, the use of isolators can reduce or even avoid emptying of electrolyte, if interruption of the stray current and load current between electrolysis cells is enabled. For this purpose, for example, the first isolator may be introduced when, in particular, a gas is formed in the electrolysis in order to achieve interruption of the stray currents and load currents on the electrolyte supply side. Correspondingly, the second isolator can reduce stray currents and load currents on the drain side. In particular embodiments, the first and second isolator are introduced, such that the first electrolysis cell overall is isolated. Alternatively or additionally, on the feed side, the third isolator can prevent flow of current between the two electrolysis cells, and/or, on the drain side, the fourth isolator can prevent the flow of current between the two electrolysis cells. In particular embodiments, the first and second or fourth isolator are introduced in order to prevent flow of current both on the feed side and on the drain side. In particular embodiments, the third and the second or fourth isolator are introduced in order to prevent flow of current both on the feed side and on the drain side.

In the case of multiple electrolysis cells, as also elucidated in principle above in connection with the method of the first aspect, the flow of current should preferably correspondingly also be prevented between all electrolysis cells or at least the marginal electrolysis cells. For this purpose, isolators may be provided in all feeds or in all but one feed, in all drains or in all but one drain, in the overall feed in flow direction of the electrolyte between each of the feeds and/or in the overall drain in flow direction of the electrolyte between each of the drains, or correspondingly solely in the feeds and/or drains at the margin of the stack and/or the corresponding sites (for example between adjacent electrolysis cells at the margin of the stack) in the overall feed and/or overall drain.

The third method may further comprise introduction of at least one fifth isolator at least into the at least one second feed to the second electrolysis cell in such a way that at least the entire cross-sectional area of the at least one second feed is occupied by the second isolator. The first isolator and fifth isolator can thus correspondingly achieve additional isolation on the feed side, including with regard to the overall feed. Alternatively or additionally, the third isolator may be introduced together with a sixth isolator in the second drain for further isolation on the drain side.

In particular embodiments, in the methods of the invention, or else in the third method, the at least one first feed may be disposed beneath the first electrolysis cell and/or the at least one second feed and any further feeds beneath the second electrolysis cell. The employment of the method of the invention, or else of the third method, is greatly facilitated by electrolyte feeds from the underside of the stack.

It is also not ruled out in the third method that a respective electrolysis cell may have more than one electrolyte, for example a catholyte on the cathode side and an anolyte on the anode side, which may be separated, for example, by a suitable separator, e.g. a diaphragm or membrane, in the respective electrolysis cell. In this case, for example, the catholyte is fed in via at least a first and at least a second catholyte feed and an overall catholyte feed, and a catholyte is removed via at least a first and at least a second catholyte drain and an overall catholyte drain, and the anolyte is fed in via at least a first and at least a second anolyte feed and an overall anolyte drain, and an anolyte is removed via at least a first and at least a second anolyte drain and an overall anolyte drain, which may correspondingly have a respective isolator, i.e., for example, a first catholyte isolator, a second catholyte isolator, etc., and/or a first anolyte isolator, a second anolyte isolator, etc.

Additionally disclosed is a $CO_2$ electrolysis stack comprising:

at least a first electrolysis cell (10) and a second electrolysis cell (20), at least a first feed and at least a first drain for the first electrolysis cell (10), at least a second feed and at least a second drain for the second electrolysis cell (20), an overall feed which is connected to the at least one first feed and the at least one second feed and is designed to provide an inlet for the at least one first feed and the at least one second feed, and an overall drain which is connected to the at least one first drain and the at least one second drain and is designed to provide an outlet for the at least one first drain and the at least one second drain, further comprising:

at least one first side drain which is connected to the at least one first feed and is designed such that it can at least partly empty any electrolyte present in the at least one first feed therefrom, at least one second side drain which is connected to the at least one first drain and is designed such that it can at least partly empty any electrolyte present in the at least one first drain therefrom, at least one third side drain which is connected to the at least one second feed and is designed such that it can at least partly empty any electrolyte present in the at least one second feed therefrom, and/or at least one fourth side drain which is connected to the at least one second drain and is designed such that it can at least partly empty any electrolyte present in the at least one second drain therefrom, further comprising a first side feed which is connected to the at least one first feed and is designed such that it can supply an inert gas or a mixture comprising an inert gas and liquid droplets present therein to the at least one first feed, a second side feed which is connected to the at least one first drain and is designed such that it can supply an inert gas or a mixture comprising an inert gas and liquid droplets present therein to the at least one first drain, a third side feed which is connected to the at least one second feed and is designed such that it can supply an inert gas or a mixture comprising an inert gas and liquid droplets present therein to the at least one second feed, and/or a fourth side feed which is connected to the at least one second drain and is designed such that it can supply an inert gas for a mixture comprising an inert gas and liquid droplets present there into the at least one second drain, wherein the inert gas is $CO_2$.

An electrolysis stack, especially a $CO_2$ electrolysis stack is described, comprising:

at least a first electrolysis cell and a second electrolysis cell, at least a first feed and at least a first drain for the first electrolysis cell, at least a second feed and at least a second drain for the second electrolysis cell, an overall feed which is connected to the at least one first feed and the at least one second feed and is designed to provide an inlet for the at least one first feed and the at least one second feed, and an overall drain which is connected to the at least one first drain and the at least one second drain and is designed to provide an outlet for the at least one first drain and the at least one second drain, further comprising:

at least one first isolating barrier device comprising a first isolator in the at least one first feed, which is designed to close the at least one first feed in such a way that at least the entire cross-sectional area of the at least one first feed is occupied by the first isolator; or at least one first barrier device in the at least one first feed which is designed to close the at least one first feed, and at least one first release device which is designed such that it can at least partly empty any electrolyte present in the at least one first feed comprising the first barrier device therefrom; and/or at least one first side drain which is connected to the at least one first feed and is designed such that it can at least partly empty any electrolyte present in the at least one first feed therefrom; and/or at least one first overall side drain which is connected to the overall feed and is designed such that it can at least partly empty any electrolyte present in the overall feed therefrom.

The first and second feeds here are each designed to supply an electrolyte to the first and second electrolysis cells, and the first and second drains are each designed to remove an electrolyte from the first and second electrolysis cells, although it is not ruled out that the electrolyte on draining possibly also comprises electrolysis products.

Correspondingly, the overall feed is designed to supply an electrolyte to all feeds, i.e., for example, to the first and second feeds, and the overall drain is designed to remove the electrolyte and any electrolysis products from all drains, i.e., for example, from the first and second drains, after passage through the electrolysis cell.

The corresponding components of the $CO_2$ electrolysis stack of the invention or of the electrolysis stack described correspond to the components in the methods of the invention or methods described, and are not particularly restricted. In this respect, reference is also made to the corresponding details of the methods of the invention and methods described, which are also respectively applicable to the $CO_2$ electrolysis stack of the invention and the electrolysis stack described.

For instance, each electrolysis cell in a $CO_2$ electrolysis stack of the invention or electrolysis stack described may comprise further feeds which, for example, supply a reactant, for example a reactant gas cathode feed, for example for a gas comprising $CO_2$ on the cathode side, or another reactant with a general cathode feed, and/or a gas and/or a liquid on the anode side, for example an anode feed, and corresponding cathode product and/or anode product drains. In particular embodiments, at least one reactant gas cathode feed per electrolysis cell is included, which is designed to supply a reactant gas comprising $CO_2$. In particular embodiments, one cathode product drain per electrolysis cell is additionally provided, which is designed to remove an electrolysis product on the cathode side. Correspondingly, in particular embodiments, anode reactant feeds and/or anode product drains are also provided for each electrolysis cell, each of which is respectively designed to supply a reactant to the anode or to remove a product from the anode. The respective reactant feeds and/or product drains are also not particularly restricted. It is possible to supply a reactant to the reactant feeds for all electrolysis cells via a common overall reactant feed, possibly also separately for reactants at the cathodes and anodes in the respective electrolysis cells, and to remove products from the electrolysis cells, after they have been removed via the respective product drains, via a common overall product drain, possibly likewise separately for products from the cathodes and anodes of the respective electrolysis cells.

It is also not ruled out that a respective electrolysis cell in the $CO_2$ electrolysis stack or the electrolysis stack described has more than one space for an electrolyte, for example a catholyte space on the cathode side and an anolyte space on the anode side, which may be separated, for example, by a suitable separator, for example a diaphragm or a membrane, in the respective electrolysis cell. The electrolyte spaces, and also any separators present, and also further constituents of the respective electrolysis cells, are not particularly restricted. In particular embodiments, the cathodes of the respective electrolysis cells are gas diffusion electrodes, and are correspondingly suitable, for example, for a reduction of $CO_2$.

In particular embodiments, the $CO_2$ electrolysis stack or the electrolysis stack described comprises a multitude of electrolysis cells having a number of three or more, for example four or more, five or more, six or more, seven or more, eight or more or nine or more, preferably ten or more, further preferably 20 or more, especially preferably 50 or more, electrolysis cells. Each electrolysis cell then correspondingly has at least one feed and at least one drain for an electrolyte, as set out above, but may also have multiple feeds and drains, for example also for separate catholytes and anolytes, and each electrolysis cell may also have a cathode space, an anode space and a separator, or else solely an electrolyte space, and also corresponding reactant feeds and product drains, as described above.

The at least one first isolating barrier device is not particularly restricted, and comprises at least one first isolator, as already described above in connection with the third method, and may correspondingly be of the same type as in the third method. In addition, the first barrier device may comprise further constituents, for example a first automatic closure device which is designed to introduce the first isolator into the first feed in such a way that at least the entire cross-sectional area of the at least one first feed is occupied by the first isolator. Of course, the first automatic closure device may also, on restart, extract the first isolator from the first feed again in such a way that conduction of electrolyte through the first feed is again enabled. As well as or instead of the first isolating barrier device, there may also be provision in the electrolysis cell of a second isolating barrier device comprising a second isolator in the at least one first drain which is designed to close the at least one first drain in such a way that at least the entire cross-sectional area of the at least one first drain is occupied by the second isolator, a third isolating barrier device comprising a third isolator in the overall feed which is designed to close the overall feed in such a way that at least the entire cross-sectional area of the overall feed in flow direction between the at least one first feed and the at least one second feed is occupied by the third isolator, a fourth isolating barrier device comprising a fourth isolator in the overall drain which is designed to close the overall drain in such a way that at least the entire cross-sectional area of the overall drain in flow direction between the at least one first drain and the at least one second drain is occupied by the fourth isolator, a fifth isolating barrier device comprising a fifth isolator in the at least one second feed which is designed to close the at least one second feed in such a way that at least the entire cross-sectional area of the at least one second feed is occupied by the fifth isolator, and/or a sixth isolating barrier device comprising a sixth isolator in the at least one second drain which is designed to close the at least one second drain in such a way that at least the entire cross-sectional area of the at least one second drain is occupied by the sixth isolator. It is also possible for the second, third, fourth, fifth and/or sixth isolating barrier device to comprise further constituents, for example a second, third, fourth, fifth and/or sixth automatic closure device which is designed to introduce the second, third, fourth, fifth and/or sixth isolator into the first drain, overall feed, overall drain, second feed and/or second drain, in such a way that at least the entire cross-sectional area of the at least one first feed is occupied by the first isolator. It is of course possible for the second, third, fourth, fifth and/or sixth automatic closure device, on restart, to extract the second, third, fourth, fifth and/or sixth isolator from the first drain, overall feed, overall drain, second feed and/or second drain again in such a way that conduction of electrolyte through the first drain, overall feed, overall drain, second feed and/or second drain is again enabled. The first, second, third, fourth, fifth and/or sixth isolator may be the same or different and may be of the same type as described above in connection with the method of the third aspect. The first, second, third, fourth, fifth and/or sixth automatic closure device are not particularly restricted and may be controlled, for example, by means of one or more control devices.

If the electrolysis stack comprises multiple electrolysis cells, there may correspondingly also be provision of further isolating barrier devices comprising corresponding isolators, and also optionally further automatic closure devices that are controlled by one or more control devices, as also described at least in part in connection with the third method.

There is also no particular restriction in the at least one first barrier device in the at least one first feed which is designed to close the at least one first feed, and in at least one first release device which is designed such that it can empty any electrolyte present in the at least one first feed comprising the first barrier device therefrom, preferably essentially completely and especially completely. The first barrier device may, for example, also be electrically noninsulating, but may also be electrically insulating. With the configuration specified, it is especially possible to conduct the method of the first aspect to which reference is being made here.

Alternatively or additionally may comprise, in the electrolysis stack, a second barrier device in the at least one first drain which is designed to close the at least one first drain, and at least one first release device which is designed such that it can empty any electrolyte present in the at least one first drain comprising the second barrier device therefrom at least partly, preferably essentially completely and especially completely, a third barrier device in the overall feed which is designed to close the overall feed, and at least one third release device which is designed such that it can empty any electrolyte present in the overall feed comprising the third barrier device therefrom at least partly, preferably essentially completely and especially completely, a fourth barrier device in the overall drain which is designed to close the overall drain, and at least one fourth release device which is designed such that it can empty any electrolyte present in the overall drain comprising the fourth barrier device therefrom at least partly, preferably essentially completely and especially completely, a fifth barrier device in the at least one second feed which is designed to close the at least one second feed, and at least one fifth release device which is designed such that it can empty any electrolyte present in the at least one second feed comprising the fifth barrier device therefrom at least partly, preferably essentially completely and especially completely, and/or a sixth barrier device in the at least one second drain which is designed to close the at least one second drain, and at least one sixth release device which is designed such that it can empty any electrolyte present in the at least one second drain comprising the fifth barrier device therefrom at least partly, preferably essentially completely and especially completely. The second, third, fourth, fifth and/or sixth barrier device may, for example, likewise be electrically noninsulating, but may also be electrically insulating. The first to sixth barrier devices may also be controlled by means of one or more control devices and may also be opened again, for example in a startup, in accordance with the isolating barrier devices. They are not particularly restricted and may be configured, for example, as slide gates, locks, valves, etc. The second to sixth release devices are not particularly restricted either.

If the electrolysis stack comprises multiple electrolysis cells, it is correspondingly also possible to provide further barrier devices that are controlled by one or more control devices, and also corresponding further release devices.

There is likewise no particular restriction in the at least one first overall side drain which is connected to the overall feed and is designed such that it can empty any electrolyte present in the overall feed therefrom at least partly, preferably essentially completely and especially completely. In such configurations, the overall feed preferably comprises a first overall barrier device which is disposed between the first overall side drain and the overall feed and is closed in operation in order to prevent emptying of the electrolyte, but can be opened in nonoperation in order to at least partly empty the overall feed.

Alternatively or additionally, a second overall side drain may be provided, which is connected to the overall drain and is designed such that it can empty any electrolyte present in the overall drain therefrom at least partly, preferably essentially completely and especially completely, and this is likewise not particularly restricted. In such configurations, the overall drain preferably comprises a second overall barrier device which is disposed between the second overall side drain and the overall drain and is closed in operation in order to prevent emptying of electrolyte, but can be opened in nonoperation in order to at least partly empty the overall drain.

The first overall barrier device and/or the second overall barrier device may be controlled by means of one or more control devices and are not particularly restricted, and may be configured, for example, as a slide gate, lock, valve, etc.

There is also no particular restriction in the at least one first side drain which is connected to the at least one first feed and is designed such that it can empty any electrolyte present in the at least one first feed therefrom at least partly, preferably essentially completely or preferably completely.

Alternatively or additionally, there may be provision of at least one second side drain which is connected to the at least one first drain and is designed such that it can empty any electrolyte present in the at least one first drain therefrom at least partly, preferably essentially completely or preferably completely, at least one third side drain which is connected to the at least one second feed and is designed such that it can empty any electrolyte present in the at least one second feed therefrom at least partly, preferably essentially completely or preferably completely, and/or at least one fourth side drain which is connected to the at least one second drain and is designed such that it can empty any electrolyte present in the at least one second drain therefrom at least partly, preferably essentially completely or preferably completely, and these are not particularly restricted. For this purpose, it is also possible in turn to provide corresponding barrier devices in the respective feeds and/or drains, for example even more than one, for example two. Corresponding configurations are also specified in connection with the method of the first aspect, to which reference is made here too with regard to further configurations.

In particular embodiments, the electrolysis stack of the invention comprises at least one first side drain which is connected to the at least one first feed and is designed such that it can empty any electrolyte present in the at least one first feed therefrom at least partly, preferably essentially completely and especially completely, and further comprises a first side feed which is connected to the at least one first feed and is designed such that it can supply an inert gas, a mixture comprising an inert gas and liquid droplets present therein, or an electrically nonconductive liquid which is immiscible with the electrolyte to the at least one first feed. The first side feed is not particularly restricted either.

Alternatively or additionally, the electrolysis stack of the invention comprises at least one second side drain which is connected to the at least one first drain and is designed such that it can empty any electrolyte present in the at least one first drain therefrom at least partly, preferably essentially completely and essentially especially completely, and further comprises a second side feed which is connected to the at least one first drain and is designed such that it can supply an inert gas, a mixture comprising an inert gas and liquid droplets present therein, or an electrically nonconductive liquid which is immiscible with the electrolyte to the at least one first drain. The second side feed is not particularly restricted either.

Alternatively or additionally, the electrolysis stack of the invention comprises at least one third side drain which is connected to the at least one second feed and is designed such that it can empty any electrolyte present in the at least one second feed therefrom at least partly, preferably essentially completely and especially completely, and further comprises a third side feed which is connected to the at least one second feed and is designed such that it can supply an inert gas, a mixture comprising an inert gas and liquid droplets present therein, or an electrically nonconductive liquid which is immiscible with the electrolyte to the at least one second feed. The third side feed is not particularly restricted either.

Alternatively or additionally, the electrolysis stack of the invention comprises at least one fourth side drain which is connected to the at least one second drain and is designed such that it can empty any electrolyte present in the at least one second drain therefrom at least partly, preferably essentially completely and especially completely, and further comprises a fourth side feed which is connected to the at least one second drain and is designed such that it can supply an inert gas, a mixture comprising an inert gas and liquid droplets present therein, or an electrically nonconductive liquid which is immiscible with the electrolyte to the at least one second drain. The fourth side feed is not particularly restricted either.

If the electrolysis stack comprises multiple electrolysis cells, it is correspondingly also possible to provide further side drains which are connected to further feeds and/or drains and are designed such that they can empty any electrolyte present in the further feeds and/or drains therefrom at least partly, preferably essentially completely and especially completely, and preferably further side feeds which are connected to the further feeds and/or drains and are designed such that they can supply an inert gas, a mixture comprising an inert gas and liquid droplets present therein, or an electrically nonconductive liquid which is immiscible with the electrolyte to the further feeds and/or drains.

Side drains and side feeds, in preferred embodiments, are preferably opposite one another in the respective feeds and/or drains.

In addition, the electrolysis stack may comprise one or more pumps that are designed to pump an inert gas, a mixture comprising an inert gas and liquid droplets present therein, or an electrically nonconductive liquid which is immiscible with the electrolyte at least partly into the first feed, first drain, second feed, second drain, overall feed, overall drain and/or further feeds and/or drains and/or the electrolysis cells, and also a reservoir or multiple reservoirs containing an inert gas, a mixture comprising an inert gas and liquid droplets present therein, or an electrically non-conductive liquid which is immiscible with the electrolyte, and from which the gas can be pumped into the corresponding feeds and/or drains and optionally also the electrolysis cells. In a $CO_2$ electrolysis, the inert gas used may also be optionally moistened gas comprising $CO_2$ or consisting of $CO_2$, such that extra reservoirs can be dispensed with and the inert gas can be provided from the reactant supply to the cathodes, for which it is correspondingly also possible to provide a linking conduit between, for example, a reactant gas cathode feed, for example even an overall reactant gas cathode feed that can provide the reactant gas for all reactant gas cathode feeds, and, for example, the overall feed, although this is interrupted by a reactant gas barrier device in the linking conduit, in which case the reactant gas barrier device can be opened in nonoperation.

If the electrolysis cells in the electrolysis stack have more than one electrolyte space, i.e., for example, a catholyte space on the cathode side and an anolyte space on the anode side, for each electrolyte space, there are correspondingly feeds, drains, overall feed and overall drain, isolating barrier devices with corresponding isolators, barrier devices, side drains, side feeds, overall side drains, overall barrier devices, etc., i.e., for example, a first and second catholyte feed, a first and second anolyte feed, an overall catholyte feed, an overall anolyte feed, first to sixth isolating catholyte barrier devices with first to sixth catholyte isolators, first to sixth isolating anolyte barrier devices with first to sixth anolyte isolators, first to sixth catholyte barrier devices, first to sixth anolyte barrier devices, first to fourth catholyte side feeds and drains, first to fourth anolyte side feeds and drains, an overall catholyte side drain, an overall anolyte side drain, an overall catholyte barrier device, an overall anolyte barrier device, etc., which may be respectively arranged for catholyte and anolyte as described above, and further corresponding constituents for catholyte and anolyte supply and catholyte and anolyte removal, etc. However, it is not ruled out here that the corresponding insulating barrier devices, insulators, barrier devices, side feeds and drains, the overall side drain, the overall barrier device, etc. are provided solely for the catholyte or anolyte, for example solely the catholyte, for example when corrosion is more likely on the catholyte side or anolyte side, for example for gas diffusion electrodes, for example on the catholyte side in a $CO_2$ electrolysis. Correspondingly, such embodiments are also applicable to the methods of the invention, where such measures are thus taken solely on the catholyte side or anolyte side.

In the methods of the invention and the $CO_2$ electrolysis stack of the invention, or electrolysis stack described, it is possible for side feeds and drains, if present, also to include barrier devices therein which can then be closed for operation, such that no electrolyte is lost via the side feeds and drains in operation.

The above embodiments, configurations and developments can, if viable, be combined with one another as desired. Further possible configurations, developments and implementations of the invention also include combinations of features of the invention that have been described above or are described hereinafter with regard to the working examples, even combinations that have not been specified explicitly. In particular, the person skilled in the art will also add individual aspects as improvements or additions to the respective basic form of the present invention.

The invention is elucidated further in detail hereinafter with reference to various examples thereof. However, the invention is not limited to these examples.

Example 1

Figure 5:
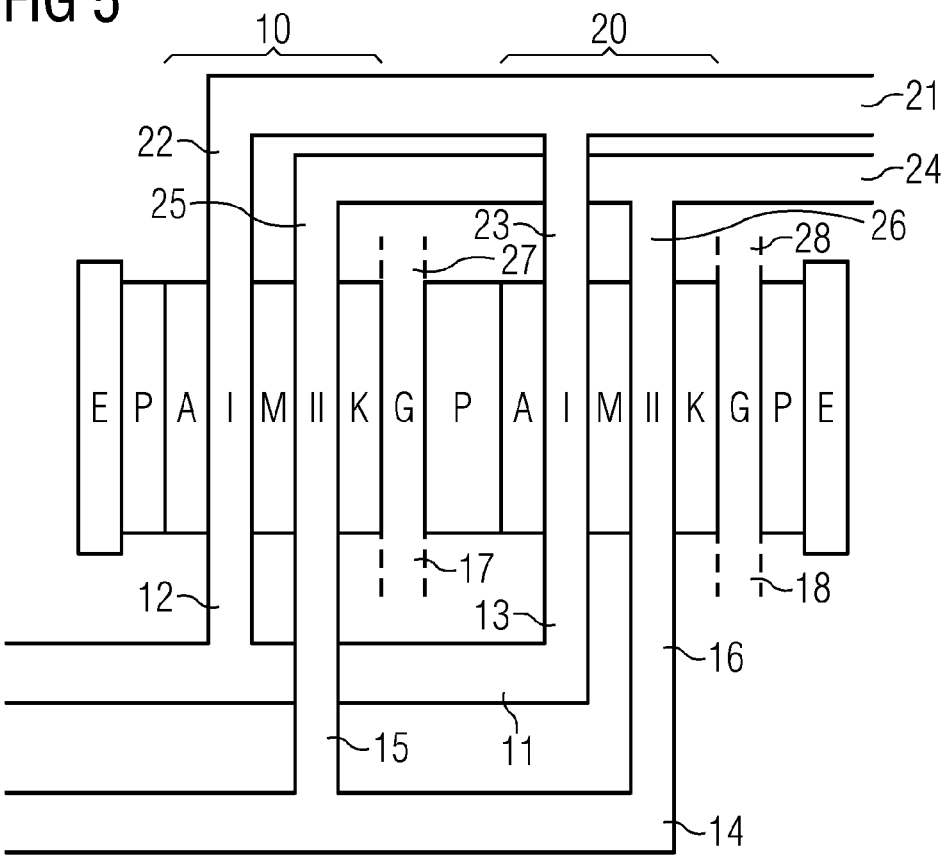
FIG. 5 shows a schematic of an electrolysis stack with two electrolysis cells and a distribution structure for electrolytes.

An illustrative method of the invention can be performed in an electrolysis stack shown in FIG. 5. This electrolysis stack has a first electrolysis cell 10 and a second electrolysis cell 20, each of which has an anode A, an anolyte space I for anolyte, a membrane M, a catholyte space II for catholyte, a cathode K and a gas space G on the cathode side, with a bipolar plate P disposed between the two electrolysis cells 10 and 20, and also at the other ends thereof. End plates E are disposed on the outside. The reactant gas used for the cathode is, for example, moistened $CO_2$, which is supplied to the respective gas space G via reactant gas cathode feeds 27 and 28. The product gas from the electrolysis is removed via the product gas cathode drains 17 and 18. The feed of anolyte to the two electrolysis cells 10 and 20 in operation is via the overall anolyte feed 11 and the first anolyte feed 12 and the second anolyte feed 13, and the removal is via the first anolyte drain 22, the second anolyte drain 23 and the overall anolyte drain 21. The feed of catholyte to the two electrolysis cells 10 and 20 in operation is via the overall catholyte feed 14 and the first catholyte feed 15 and the second catholyte feed 16, and the removal is via the first catholyte drain 25, the second catholyte drain 26 and the overall catholyte drain 24.

In nonoperation, the overall anolyte feed 11, the first anolyte feed 12, the second anolyte feed 13, the two anolyte spaces I, the first anolyte drain 22, the second anolyte drain 23, the overall anolyte drain 21, the overall catholyte feed 14, the first catholyte feed 15, the second catholyte feed 16, the two catholyte spaces II, the first catholyte drain 25, the second catholyte drain 26 and the overall catholyte drain 24 are filled essentially and preferably completely with an inert gas, e.g. $CO_2$, which may be moistened, and may correspond to the reactant gas from the cathode, and the anolyte and catholyte are essentially and preferably completely emptied. By comparison with an electrolysis stack in which the catholyte and anolyte are not emptied in nonoperation, the result is a reduction in corrosion, especially at the anodes A and cathodes K, especially at the cathode K, which takes the form of a gas diffusion electrode.

Example 2

Figure 6:
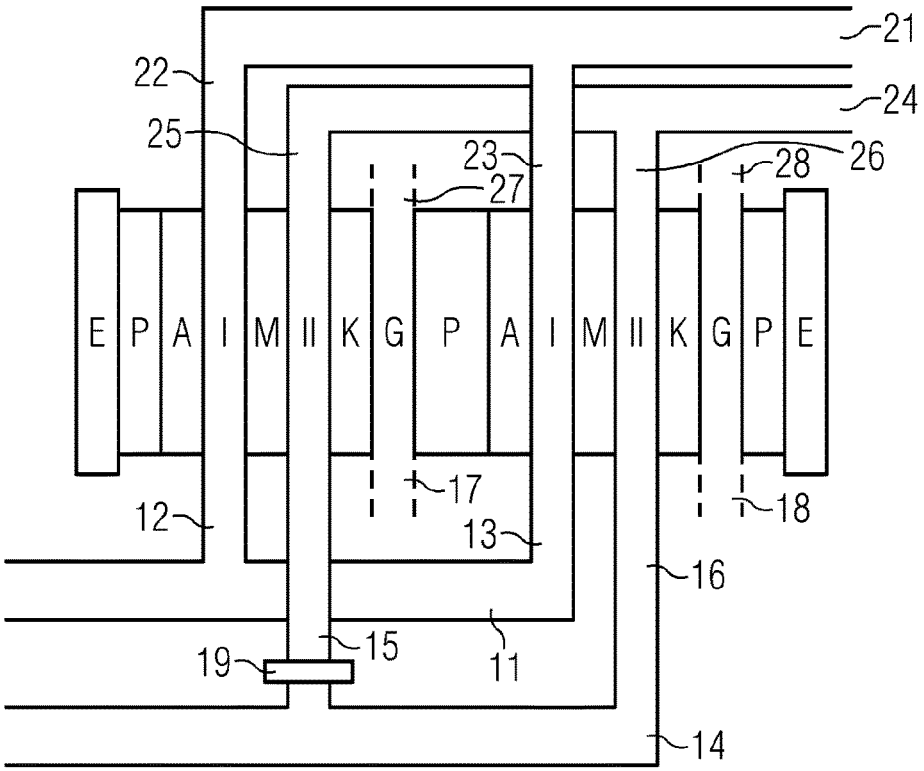
FIGS. 6 to 11 show schematics of electrolysis stacks, especially $CO_2$ electrolysis stacks.

The electrolysis stack in FIG. 6 is used in example 1 rather than the electrolysis stack from FIG. 5. The construction of the electrolysis stack corresponds to that in FIG. 5, except that a first catholyte isolator 19 provided in the first catholyte feed 15 is introduced into the first catholyte feed in nonoperation, as shown in FIG. 6. This prevents stray currents and load currents on the cathode side on the feed side, and so corrosion at the cathode can be prevented.

Example 3

Figure 7:
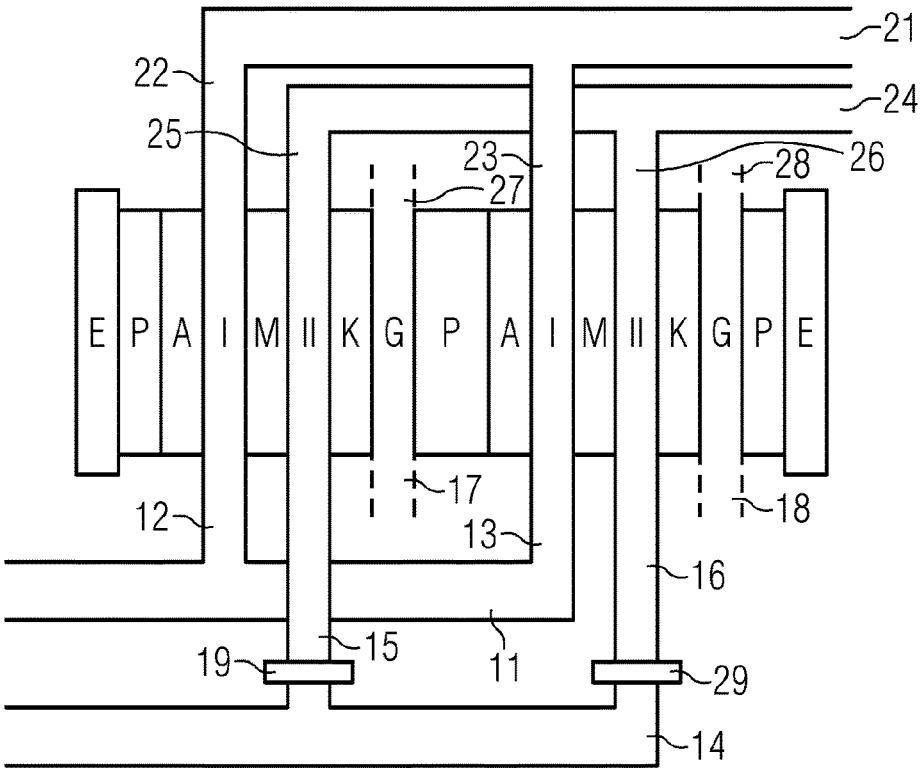

The electrolysis stack in FIG. 7 is used in example 2 rather than the electrolysis stack from FIG. 6. The construction of the electrolysis stack corresponds to that in FIG. 6, with additional provision in the second catholyte feed 16 of a further catholyte insulator 29 (the third according to the above description), which additionally reduces stray currents and load currents via, for example, a catholyte circuit.

Example 4

Figure 8:
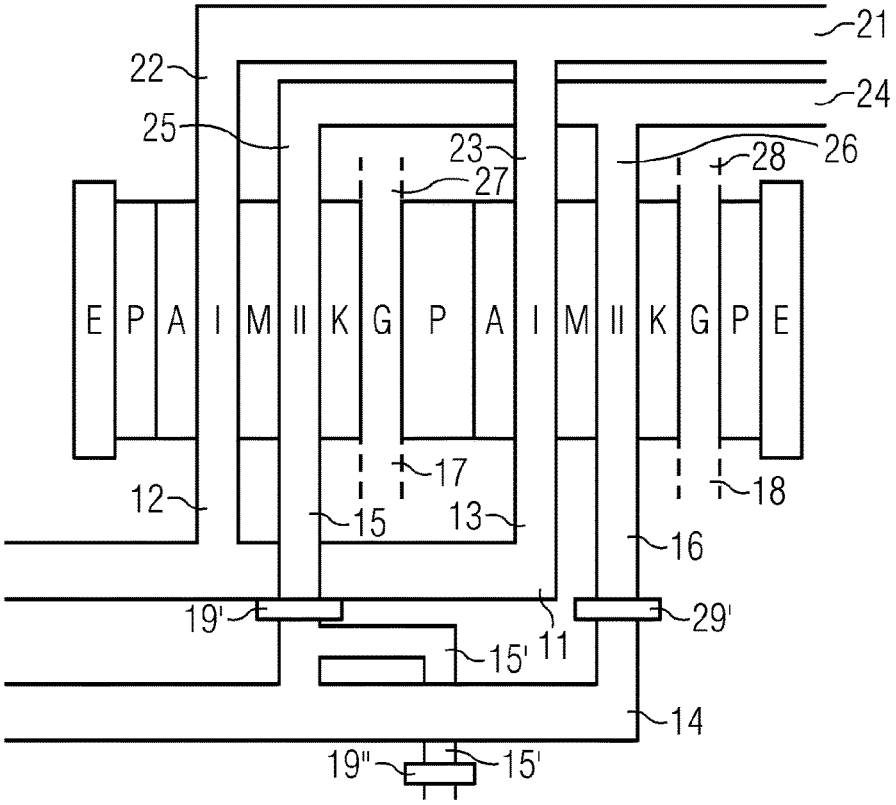

The electrolysis stack in FIG. 8 is used in example 1 rather than the electrolysis stack from FIG. 5. Additionally provided is a first catholyte barrier device 19' in the first catholyte feed 15 and a further catholyte barrier device 29' (the third according to the above description) in the second catholyte feed 16, and a first catholyte side drain 15' in the first catholyte feed 15. In the first catholyte side drain 15', there is additionally a first catholyte side drain barrier device 19", but this ideally directly adjoins the first catholyte feed 15. In operation, the first catholyte side drain barrier device 19" is closed and catholyte is not lost via the first catholyte side drain 15'; the first catholyte barrier device 19' and the further catholyte barrier device 29' are open. In nonoperation, the first catholyte barrier device 19' and the further catholyte barrier device 29' are closed, and the first catholyte side drain barrier device 19" is opened. Catholyte is emptied at least partly, preferably essentially completely and especially completely via the first catholyte side drain 15' from the overall catholyte feed 14, parts of the first catholyte feed 15 and optionally parts of the second catholyte feed 16 (as shown here schematically in FIG. 8). The catholyte may be replaced, for example, by moistened $CO_2$.

Example 5

Figure 9:
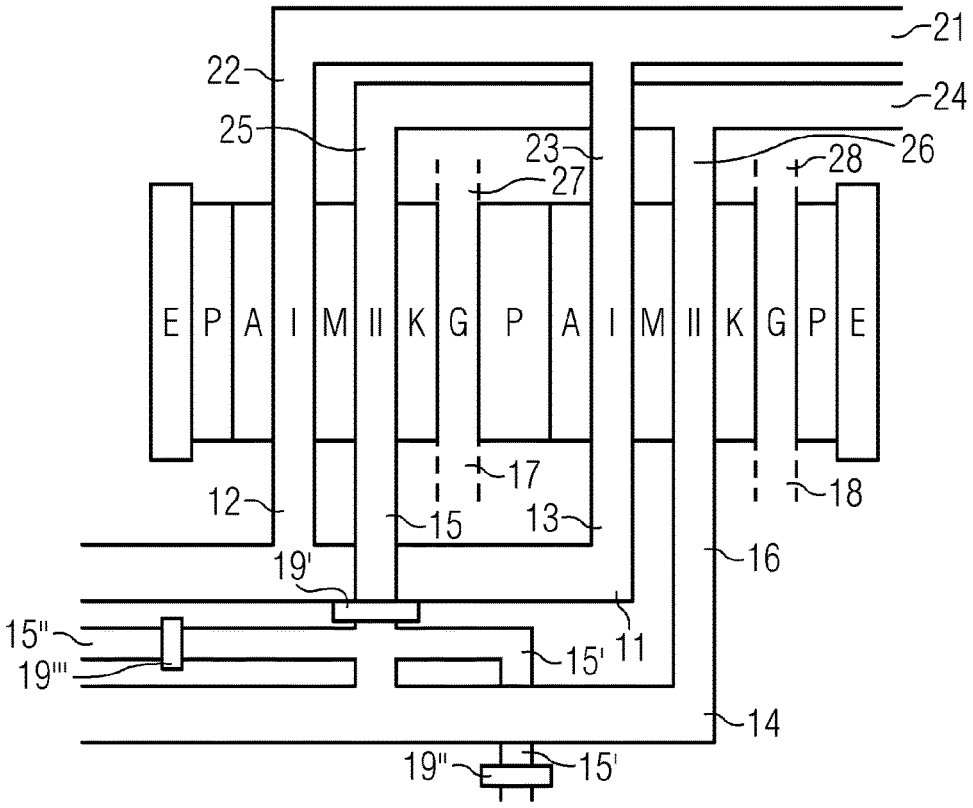

The electrolysis stack in FIG. 9 is used in example 1 rather than the electrolysis stack from FIG. 5. In addition, a first catholyte barrier device 19' is provided in the first catholyte feed 15, as are a first catholyte side drain 15' with a first catholyte side drain barrier device 19" and a first catholyte side feed 15" with a first catholyte side feed barrier device 19'". Ideally, the first catholyte side drain barrier device 19" and the first catholyte side feed barrier device 19'" lie directly on the first catholyte feed 15. In operation, the first catholyte barrier device 19' is open, and the first catholyte side drain barrier device 19" and the first catholyte side feed barrier device 19'" are closed. In nonoperation, the first catholyte barrier device 19' is closed, and the first catholyte side drain barrier device 19" and the first catholyte side feed barrier device 19'" are opened, and moistened $CO_2$ is passed through the first catholyte side feed 15" and the first catholyte side drain 15', which are opposite one another here on the first catholyte feed 15, in order to interrupt the electrolyte in a portion of the first catholyte feed 15. It is then optionally possible here for the first catholyte barrier device 19' also to be open or opened. The interruption of the catholyte on the feed side in the first catholyte feed 15 in turn reduces load currents and stray currents.

Example 6

Figure 10:
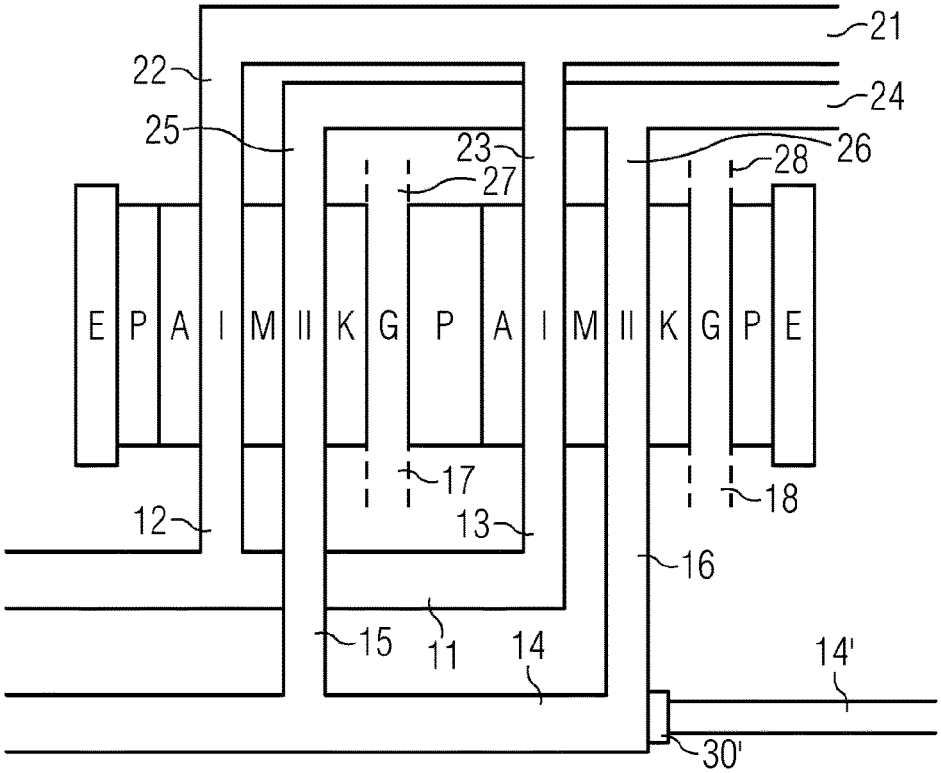

The electrolysis stack in FIG. 10 is used in example 1 rather than the electrolysis stack from FIG. 5. Additionally provided in the overall catholyte feed 14 is an overall catholyte side drain 14' which is separated in operation from the overall catholyte feed 14 by a closed first overall catholyte barrier device 30', which prevents flow of catholyte into the overall catholyte side drain 14'. In nonoperation, the catholyte at least in the overall catholyte feed 14, after opening of the first overall catholyte barrier device 30', is emptied at least partly, preferably essentially completely or preferably completely via the overall catholyte side drain 14', in the course of which it can be replaced, for example, by moistened $CO_2$ or an inert liquid in order to suppress runback of catholyte from the first catholyte feed 15 and the second catholyte feed 16.

Example 7

Figure 11:
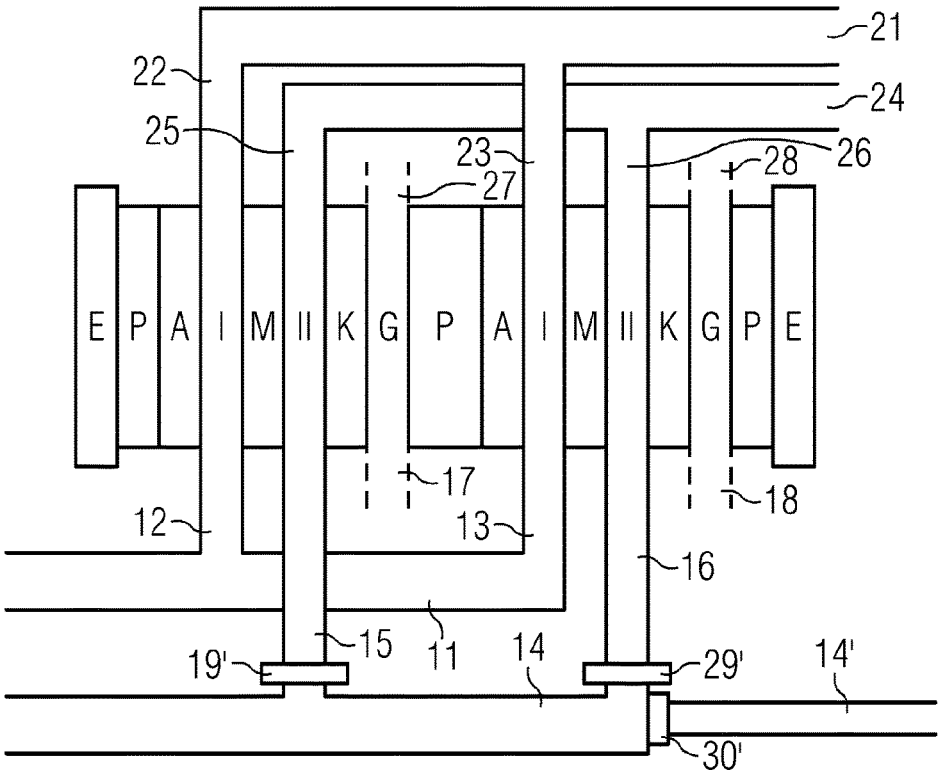

The electrolysis stack in FIG. 11 is used in example 6 rather than the electrolysis stack from FIG. 10. In order, in nonoperation, to further prevent runback of catholyte from the first catholyte feed 15 and the second catholyte feed 16, the first catholyte barrier device 19' and the further catholyte barrier device 29' (the third according to the above description) from example 4 are provided in the first catholyte feed 15 and the second catholyte feed 16, which are open in operation and closed in nonoperation.

The invention claimed is:

1. A method of protecting a nonoperational $CO_2$ electrolysis stack from corrosion, wherein the $CO_2$ electrolysis stack comprises at least a first electrolysis cell and a second electrolysis cell, at least one first feed and at least one first drain for the first electrolysis cell and at least one second feed and at least one second drain for the second electrolysis cell, wherein at least the first electrolysis cell and the second electrolysis cell and at least the at least one first feed and the at least one second feed are partly filled with at least one electrolyte, the method comprising:

at least partly emptying the electrolyte from parts of at least the first electrolysis cell and/or of the at least one first feed and/or of the at least one first drain and/or of an overall feed which is connected to the at least one first feed and the at least one second feed and is designed to provide an inlet for the at least one first feed and the at least one second feed and/or of an overall drain which is connected to the at least one first drain and the at least one second drain and is designed to provide an outlet for the at least one first drain and the at least one second drain, wherein the electrolyte which is removed by the at least partial emptying is exchanged for a mixture comprising an inert gas and liquid droplets supplied with the inert gas, wherein the inert gas is $CO_2$;

wherein the partial emptying is displaced by the mixture comprising the inert gas and the liquid droplets therein;

wherein the $CO_2$ electrolysis stack comprises a gas space connected to a reactant gas; and wherein the gas space is also filled with the mixture comprising the inert gas and the liquid droplets.

2. The method as claimed in claim 1, wherein at least the at least one first feed is partly emptied.

3. The method as claimed in claim 1, wherein at least the at least one first feed and the at least one second feed are at least partly emptied in such a way that there is a region in which there is essentially no electrolyte in the at least one first feed and the at least one second feed.

4. The method as claimed in claim 1, wherein the at least one first drain and the at least one second drain are additionally at least partly emptied in such a way that there is a region in which there is essentially no electrolyte in the at least one first drain and the at least one second drain.

5. The method as claimed in claim 1, wherein the entire $CO_2$ electrolysis stack is filled with the mixture.

6. The method as claimed in claim 1, wherein the $CO_2$ electrolysis stack comprises a multitude of electrolysis cells having a number of three (3) or more electrolysis cells, wherein the electrolyte is at least partly emptied at least from parts of the electrolysis cell and/or the feeds to the electrolysis cells, in each case at an edge of the $CO_2$ electrolysis stack.

7. The method as claimed in claim 1, wherein current is applied to electrodes of the electrolysis cells.

8. The method as claimed in claim 6, wherein the partial emptying corresponds to an emptying of at least 50% by volume.

9. The method as claimed in claim 1, wherein the mixture comprising the inert gas and the liquid droplets therein displaces the electrolyte in one or more portions of the $CO_2$ electrolysis stack only; and wherein electrolyte in a remainder of the $CO_2$ electrolysis stack remains in the $CO_2$ electrolysis stack.

10. The method as claimed in claim 1, wherein electrolyte in at least one of the electrolysis cells remains therein.

11. The method as claimed in claim 1, wherein the mixture comprising the inert gas and the liquid droplets therein displaces the electrolyte in one or more of the electrolysis cells only; and wherein a remainder of the electrolyte remains.

12. The method as claimed in claim 1, wherein the mixture comprising the inert gas and the liquid droplets therein displaces the electrolyte in one or more of the feeds only; and wherein a remainder of the electrolyte remains.

13. The method as claimed in claim 1, wherein the mixture comprising the inert gas and the liquid droplets therein displaces the electrolyte in one or more of the drains only; and wherein a remainder of the electrolyte remains.

* * * * *